United States Patent [19]

Weir et al.

[11] Patent Number: 4,785,931

[45] Date of Patent: Nov. 22, 1988

[54] MOLDED PLASTIC CLOSURE HAVING INTEGRAL STACKING SUPPORT RIBS AND RUPTURABLE MIX COMPARTMENTS

[75] Inventors: Dixie L. Weir, Rochester; Don F. Yeager, Lake Orion, both of Mich.

[73] Assignee: Letica Corporation, Rochester, Mich.

[21] Appl. No.: 100,534

[22] Filed: Sep. 24, 1987

[51] Int. Cl.[4] ..... B65D 25/08; B65D 21/00

[52] U.S. Cl. ..... 206/222; 206/508; 215/6; 215/DIG. 8; 220/23; 220/278; 222/80

[58] Field of Search ..... 206/219, 221, 222, 508; 215/6, DIG. 8, 227, 228; 220/23, 212, 278; 222/80

[56] References Cited

U.S. PATENT DOCUMENTS

| | | | |
|---|---|---|---|
| 2,387,978 | 10/1945 | Casey | 220/23 X |
| 3,276,657 | 10/1966 | Speas | 206/508 X |
| 3,326,363 | 6/1967 | Bennett et al. | 206/219 |
| 3,347,410 | 10/1967 | Schwartzman | 222/80 X |
| 3,454,177 | 7/1969 | Bloom | 206/222 |
| 3,548,562 | 12/1970 | Schwartzman | 206/222 X |
| 3,743,520 | 7/1973 | Croner | 206/219 X |
| 3,796,813 | 3/1974 | Kurland | 220/23 X |
| 4,103,772 | 8/1978 | Woegner | 206/222 |

FOREIGN PATENT DOCUMENTS

| | | | |
|---|---|---|---|
| 2248789 | 4/1974 | Fed. Rep. of Germany | 206/219 |
| 1479110 | 4/1967 | France | 220/278 |

*Primary Examiner*—Stephen Marcus
*Assistant Examiner*—Bryon Gehman
*Attorney, Agent, or Firm*—Krass & Young

[57] ABSTRACT

A closure for use with a beverage container, the closure having a plurality of compartments formed therein to store quantities of a flavoring agent separately from a mixing fluid (such as water) contained in the container. The compartments are operable by simple finger pressure to release their contents into the container one at a time for the purpose of making a flavored beverage. Support ribs are formed on the closure to allow the stacking of a number of closures or closure/container combinations without inadvertently releasing the flavoring agent from the compartments.

6 Claims, 1 Drawing Sheet

MOLDED PLASTIC CLOSURE HAVING INTEGRAL STACKING SUPPORT RIBS AND RUPTURABLE MIX COMPARTMENTS

FIELD OF THE INVENTION

The present invention relates to containers for mixed ingredients such as dry-mix beverages, and more particularly to closures for such containers having one or more mix storage compartments which are rupturable to release the mix ingredients into the container.

BACKGROUND OF THE INVENTION

Many kinds of beverage flavoring agents or drink mixes are commercially available in powdered or granulated form. Such agents/mixes are easily transported, stored, and sold separately from a solvent fluid such as water. This is economical for the manufacturers, distributors, retailers, and consumers in that the steps of having to measure and mix the drink mix with water, packaging the pre-mixed beverage in a fluid-tight container, shipping the pre-mixed beverage, and possibly storing the pre-mixed beverage in a refrigerated case are eliminated prior to purchasing by the consumer. There is, however, a penalty of inconvenience in that the consumer must provide a suitable container when the mixing of ingredients is to take place.

A proposed solution to this problem has been to provide a closure for the container which contains a premeasured amount of the drink mix. U.S. Pat. No. 3,743,520 (Croner) discloses a metal beverage can having a plurality of drink mix compartments formed on the underside of a substantially flat container lid. A can opener is needed to pierce the lid and one or more of the compartments, thereby allowing the drink mix to fall into the container. To keep the top wall of his container flat to allow for stackability, Croner's closure is unnecessarily complicated, requiring two sheets of metal bonded or welded together to form the top flat wall of the closure and crimped to a third sheet of metal having the storage compartments formed therein. This is not only complicated to manufacture, but may be difficult for some persons to open with a can opener.

U.S. Pat. No. 3,548,562 (Schwartzman) discloses a screw-on closure having flexible side walls and a seal defining a single large dome-like storage compartment for holding a liquid. Two puncture rods are formed on an interior wall of the storage compartment, operable by pressure on the top walls of the closure to puncture the seal and allow the liquid to fall into the container. The Schwartzman closure is not only bulky and nearly impossible to stack, but, due to the unprotected flexible side walls which define both storage compartment and lid, is easily ruptured by accident.

U.S. Pat. No. 4,264,007 (Hunt) discloses a container having a pull-off or peel-off tab on the closure which, when removed, causes a cup-shaped drink mix compartment formed on the underside of the closure to pivot and dump its contents into the container. This structure is complicated and impractical, requiring two layers of lid material, a pull-tab, means for connecting said pull-tab to the storage compartment through the lid surface, and pivoting means for the storage compartment.

SUMMARY OF THE INVENTION

The present invention provides a mix ingredient storage capability and a mixed-ingredient storage capability in one simple, economical and easy-to-use device.

In general, the invention comprises a snap-on plastic closure suitable for use with a standard or special open-ended plastic container and having formed integrally therewith a plurality of compartments for storing mix ingredients such as powdered beverage mix. mix. Each compartment is easily ruptured by simple manual pressure to release its contents directly into the container where the mix ingredients may be dissolved in a fluid such as water or combined with other ingredients. The container is then used to store and dispense the mixed ingredients until consumed.

The closure may be integrated with the container or it may be replaceable, i.e. when the contents of a first closure are exhausted, it can be removed from the container and a new, full closure applied.

In an illustrative and specific embodiment of the invention for drink mixes and the like, the storage compartments project upwardly from the face of the closure, each containing a quantity of drink mix sealed therein by an interior layer of barrier material. An arrowhead-shaped piercer is formed on an interior wall of each of said storage compartments, operable by manual pressure on the compartment to rupture the barrier material adjacent each compartment and allow the drink mix to fall into the container, one compartment at a time. A sealing flange formed about the periphery of the closure for sealing the closure to the container projects upwardly to a height slightly greater than the height of the compartments. Support ribs approximately the same height as the flange extend inwardly from the flange. The support ribs, along with the raised flange, permit the closures or closure/container combinations to be stacked one on top of the other without causing rupture and subsequent the release of the drink mix from the storage compartments.

BRIEF DESCRIPTION OF THE DRAWINGS

These and other objects and aspects of the present invention will be more fully detailed below in conjunction with the drawings in which.

DETAILED DESCRIPTION OF THE DRAWINGS

In the following specification and claims specific terminology is utilized in the interests of clarity and a particular embodiment is described in accordance with the requirements of 35 USC 112, but it is to be understood that the same is not intended to be limiting, as indeed the invention is capable of many variations within the scope of the appended claims.

Figure 1:
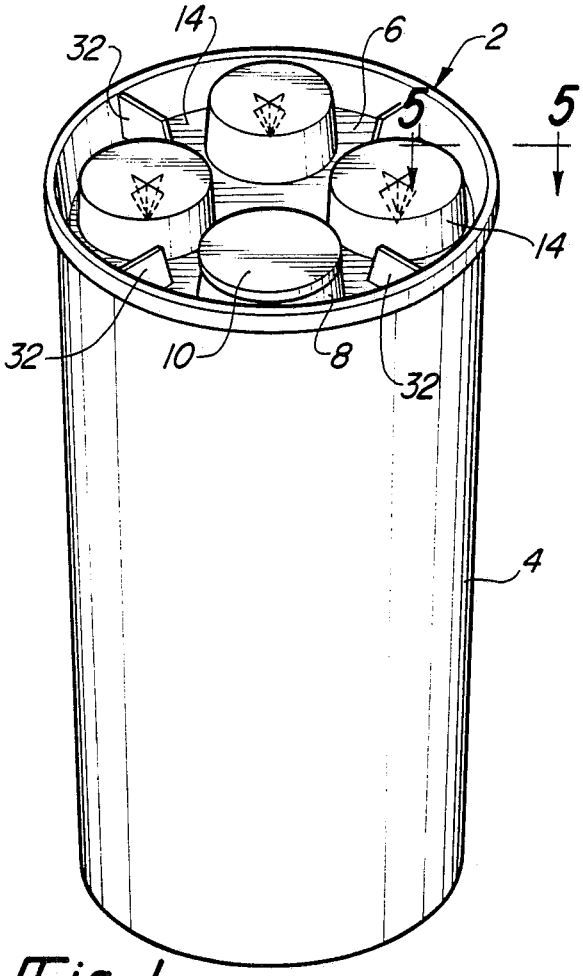
FIG. 1 is a perspective view of the closure of the present invention in combination with a beverage container.

Shown in FIG. 1 is a closure 2 engaging a cylindrical beverage container 4 in a fluid-tight and conventional manner. Closure 2 comprises a circular planar base portion 6 preferably constructed of a material which can be injection molded such as, but not limited to, polyethylene. Closure 2 has integrally molded or formed therewith a substantially cylindrical spout 8 projecting upwardly from said circular base portion 6 along the longitudinal axis of container 4 and having a snap-type cap 10 removably mounted thereon. An inverted U-shaped channel member 12 is integrally formed about the periphery of base portion 6 to sealingly engage the circular rim (not shown) of container 4 in a fluid-tight manner that is well known in the art. Closure 2 may be permanently fastened such as by adhesive or welding to container 4, but in this preferred embodiment it can be snapped on or off as desired.

Figure 2:
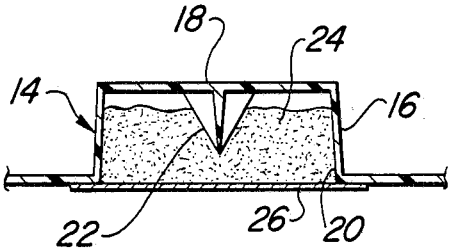
FIG. 2 is a side section view of a sealed, unused storage compartment.
Figure 3:
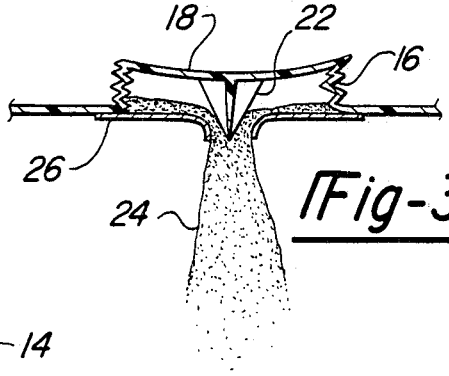
FIG. 3 is a side section view of the storage compartment of FIG. 2 being ruptured and releasing its contents into a container after manual pressure has been exerted thereon.

Referring now to FIGS. 1–3, a plurality of substantially cylindrical, hollow drink mix storage compartments 14 are also formed integrally with an on the top of said base portion 6, spaced evenly about its surface and projecting axially therefrom in a direction opposite the interior of container 4. Each compartment 14 is defined by a substantially flexible, thin-walled cylindrical side wall portion 16, a substantially flexible, thin-walled circular planar end wall portion 18 located at the end of compartment 14 opposite base portion 6 and having a diameter equal to the diameter of the cylinder formed by side wall 16, and a circular opening 20 formed in base portion 6 substantially corresponding to the diameter of end wall 18. A four-bladed, arrowhead-shaped piercing device 22 is integrally formed with each end wall 18, depending from an interior face of end wall 18 into the interior of compartment 14 with its point toward opening 20. The compartments 14 are flat topped and project no higher than the upper surface of channel member 12 thereby to permit a second container 4 to be stacked on top of closure 2.

As shown in FIG. 2, a quantity 24 of powdered or granulated drink mix, for example, is stored in compartment 14 and hermetically sealed therein by a barrier layer of adhesive foil 26 fastened to the bottom face of base portion 6 so as to completely cover opening 20. The foil 26 may comprise a plurality of sheets, one for each opening 20, or a single large sheet covering all the openings 20. Spout 8 may also be sealed by foil 26. Foil 26 serves not only as a means to secure drink mix 24 within compartments 14, but also acts as a tamper-evident seal indicating any accidental or unlawful tampering or introduction of foreign material into compartments 14 or the interior of container 4 prior to normal use by a consumer. While this preferred embodiment discloses a powder or granular material contained in compartment 14, the scope of the invention is not limited to such and may include various liquids and solids.

Referring now to FIG. 3, a person wishing to dispense the drink mix 24 into container 4 exerts downward directed pressure on end wall portion 18. The thin-walled, flexible wall portion 16 collapses accordion-fashion to bring piercer 22 into contact with adhesive foil 26, thereby rupturing foil 26 in the area immediately adjacent opening 20 and allowing drink mix 24 to flow into container 4 through a combination of gravity and pressure. The design of the four-bladed arrowhead-shaped piercer 22 serves as a sort of cam, widening the initial rupture in foil 26 as end wall 18 is further depressed. Furthermore, the space between each blade or vane of piercer 22 enhances the flow of drink mix 24 from compartment 14. Once in the container 4, drink mix 24 can be mixed and dissolved with a quantity of a fluid such as water by shaking or stirring, in order to make a flavored beverage.

Figure 4:
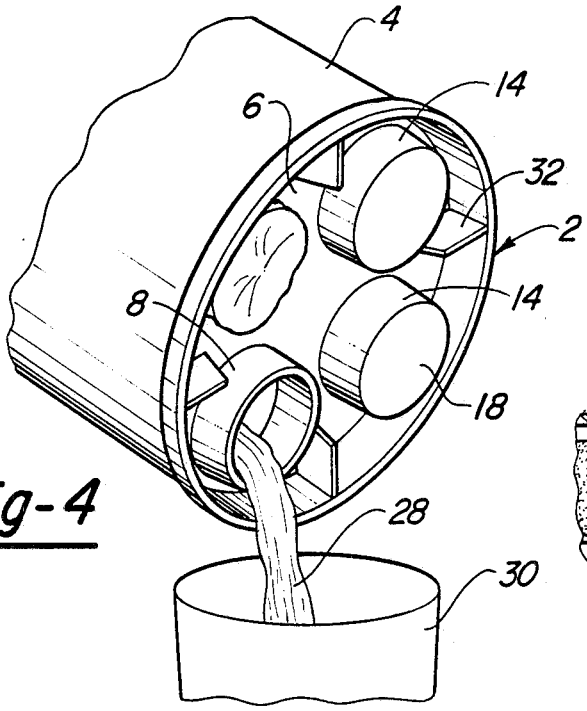
FIG. 4 is a perspective view of the closure of the present invention in combination with a beverage container being used to dispense a beverage, wherein the content of one of the storage compartments has been dispensed into the container.
Figure 5:
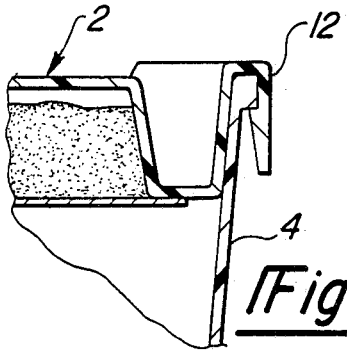
FIG. 5 is a side section taken on line 5—5 of FIG. 1.

FIG. 4 illustrates a preferred embodiment of the container/closure combination of the present invention in which one of the storage compartments 14 has been used in the above-mentioned manner to make a flavored beverage 28, which is being poured from spout 8 into a glass 30. Note that cap 10 (not shown) has been removed from spout 8 for pouring. Water and ice may be added and stored in the container prior to the rupture of compartment 14, or it may be added subsequent to the introduction of the flavoring agent into the container. Water may be introduced by way of the container mouth (not shown) in the case of a removable closure, or by way of spout 8 for a non-removable closure.

Referring again to FIG. 1, an additional feature of the invention is disclosed. Substantially rectangular, planar support ribs 32 are formed integrally with base portion 6 and flange 12 on the same face of base 6 as compartments 14 and spout 8. Support ribs 32 extend radially inwardly from flange 12 in planes perpendicular to the plane of base portion 6. The height of support ribs 32 in the direction of the axes of compartments 14 is at least equal to or greater than the height of compartments 14. Support ribs 32 not only add rigidity and strength to closure 2 during the rupture of compartments 14, but also serve to prevent the inadvertent rupture of compartments 14 when either a quantity of closures 2 or a quantity of closure 2/container 4 combinations are vertically stacked one on top of another. Since ribs 32 are slightly taller than compartments 14, they support the mass of any components stacked upon closure 2 away from compartments 14, thereby preventing pressure from being exerted on end wall portions 18.

It is to be understood that the foregoing disclosure is a preferred embodiment, and it is not intended to be limiting, as many different embodiments may lie within the scope of the invention. For example, the shape of the container 4 and/or closure 2 may take many various forms, rupture means 22 may comprise various shapes or materials, the sealing means 26 may comprise almost any suitable sheet-type material, support ribs 22 may be of a design other than that shown, etc. Also, the container/closure combination disclosed is not limited to mixing beverages, but may be used for mixing medicines, chemicals, two solids, two liquids, and so forth.

We claim:

1. A molded plastic closure for a mixing container comprising:

a base having a vertical axis of substantial symmetry when in a normal storage disposition;

inner and outer spaced, substantially-parallel, circumferentially-continuous wall portions, said inner and outer wall portions being joined at the uppermost extremities thereof to define an inverted U-shaped channel to receive the rim of said container therein;

the plane of said base being offset along said axis a predetermined distance below the upper extremities of said wall portions;

at least one downwardly opening ingredient compartment formed contiguous with said base and extending upwardly therefrom to an upper wall;

rupturable sealing means closing the bottom of said compartment; and a plurality of circumferentially spaced, substantially rigid ribs formed on said base and contiguous to the inner wall portion of said U-shaped channel and extending inwardly toward the center of said closure; said ribs extending axially at least as high as the upper wall of said compartment such that a container may be stacked thereon without collapsing said ingredient compartment along said axis.

2. A closure as defined in claim 1 further including a piercing element formed integrally with the upper wall of said ingredient compartment and extending downwardly along said axis toward said sealing means such that the application of pressure to collapse said compartment tends to drive said piercing element through said sealing means to release the ingredients within said compartment into said container.

3. A closure as defined in claim 2 wherein said piercing element is arrow-shaped and is of greatest transverse dimension immediately adjacent said upper wall.

4. A closure as defined in claim 1 wherein said sealing means is an adhesive foil.

5. A closure as defined in claim 1 further including a spout formed integrally with and on said base and in spaced relationship to said ingredient compartment.

6. A closure as defined in claim 1 wherein said ribs are non-contiguous to said ingredient compartment.

* * * * *